US011622177B2

(12) United States Patent
Nicolas et al.

(10) Patent No.: US 11,622,177 B2
(45) Date of Patent: Apr. 4, 2023

(54) LOUDSPEAKER ASSEMBLY WITH INTERNAL SCREW BOSSES

(71) Applicant: Robert Bosch GmbH, Stuttgart (DE)

(72) Inventors: Edgar Nicolas, St. Cloud, MN (US); Adam Jenson, Woodbury, MN (US); Michael D. Kasten, Burnsville, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/392,056

(22) Filed: Aug. 2, 2021

(65) Prior Publication Data

US 2023/0035619 A1 Feb. 2, 2023

(51) Int. Cl.
*H04R 1/02* (2006.01)

(52) U.S. Cl.
CPC ..... *H04R 1/02* (2013.01)

(58) Field of Classification Search
CPC .... H04R 1/2803; H04R 1/2826; H04R 1/347; H04R 1/025; H04R 1/02; H04R 27/00; H04R 1/403; H04R 1/26; H04R 2201/401; H04R 3/00; H04R 5/04; H04R 1/2896; H04N 9/3141
USPC ..... 381/386, 86, 395, 339, 333, 306, 388, 381/387, 89, 87, 182, 335, 345, 352, 341, 381/355, 346, 332; 181/199, 151, 152, 181/159, 147, 156, 148, 155, 192, 144
See application file for complete search history.

(56) References Cited

U.S. PATENT DOCUMENTS 5,956,101 A 9/1999 Yang
6,046,783 A 4/2000 Park
6,166,783 A 12/2000 Ahn
6,619,764 B2 9/2003 Sugamura
6,663,198 B2 12/2003 Sugamura
6,883,877 B2 * 4/2005 Fujii ..... H04N 5/64 348/836

(Continued)

FOREIGN PATENT DOCUMENTS

GB 2522125 A 7/2015

OTHER PUBLICATIONS

Electro-Voice ZLX Loudspeakers, Image, on sale prior to Aug. 2, 2021 (1 page).

(Continued)

*Primary Examiner* — Alexander Krzystan
*Assistant Examiner* — Julie X Dang
(74) *Attorney, Agent, or Firm* — Michael Best & Friedrich LLP

(57) ABSTRACT

A loudspeaker assembly includes an enclosure having an open front side and a wall having an interior surface and an exterior surface with a wall thickness defined therebetween. The wall is integrally molded with a screw boss supported by a plurality of molded ribs that extend inwardly from the interior surface. The loudspeaker assembly also includes an audio transducer positioned within the enclosure and having an output side facing the open front side of the enclosure to emit sound therefrom; and a mount for securing the transducer to the enclosure via a screw threaded into the screw boss. At a meeting point with the interior surface, each of the plurality of molded ribs has a rib thickness measured perpendicular to the wall thickness, the rib thickness being less than 50 percent of the wall thickness to avoid sink marks in the injection molded part.

20 Claims, 5 Drawing Sheets

(56) References Cited

U.S. PATENT DOCUMENTS

| | | | | |
|---|---|---|---|---|
| 7,096,995 | B2 | 8/2006 | Cox et al. | |
| 7,467,832 | B2 | 12/2008 | Maruta | |
| 7,796,772 | B2 * | 9/2010 | Takahashi | H04R 5/02 381/388 |
| 8,254,623 | B2 | 8/2012 | Okumura | |
| 8,356,689 | B2 * | 1/2013 | Huang | H04R 1/021 381/353 |
| 8,985,268 | B2 * | 3/2015 | Wilson | H04R 1/2803 381/345 |
| 9,313,566 | B2 * | 4/2016 | Sakurai | H04R 1/02 |
| 10,490,175 | B2 | 11/2019 | Oshiro | |
| 2004/0069561 | A1 * | 4/2004 | Cox | H04R 1/02 181/148 |
| 2004/0212744 | A1 | 10/2004 | Saitoh | |
| 2004/0223297 | A1 | 11/2004 | Kobashi et al. | |
| 2005/0196006 | A1 | 9/2005 | Suzuki | |
| 2005/0206794 | A1 | 9/2005 | Tokuda | |
| 2006/0001335 | A1 | 1/2006 | Ishii | |
| 2011/0095660 | A1 * | 4/2011 | Wang | F16B 5/0241 411/105 |
| 2012/0008095 | A1 * | 1/2012 | Sakashita | H04R 1/2896 353/15 |
| 2015/0031257 | A1 * | 1/2015 | Ootsubo | B29C 70/12 264/320 |
| 2019/0357647 | A1 | 11/2019 | Kilmer et al. | |

OTHER PUBLICATIONS

Electro-Voice EVID 6.2 Speaker, Image, on sale prior to Aug. 2, 2021 (1 page).

United Kingdom Intellectual Property Office Search Report for Application No. 2210898.9 dated Jan. 19, 2023 (1 page).

Cavitymold, "How to Improve the Sink Mark in Injection Molding," available at <https://www.cavitymold.com/how-to-mprove-the-sink-mark-in-injection-molding/> article dated May 21, 2021 (11 pages).

* cited by examiner

LOUDSPEAKER ASSEMBLY WITH INTERNAL SCREW BOSSES

BACKGROUND

The present invention relates to screw bosses for loudspeaker assemblies. A loudspeaker assembly is an electromechanical device that produces acoustic signals across a frequency range depending, at least in part, on one or more types of transducer used in the loudspeaker. The term loudspeaker can refer to a device with a single transducer, multiple drivers, or a device that includes one or more transducers, an enclosure, and additional components such as a crossover circuit. When forming the enclosure by molding, sink marks can appear on an exterior wall of the enclosure as the enclosure cools down.

SUMMARY

The invention provides, in one aspect, a loudspeaker assembly including an enclosure having an open front side and a wall having an interior surface and an exterior surface with a wall thickness defined therebetween. The wall is integrally molded with a screw boss supported by a plurality of molded ribs that extend inwardly from the interior surface. The loudspeaker assembly also includes an audio transducer positioned within the enclosure and having an output side facing the open front side of the enclosure to emit sound therefrom and includes a mount for securing the transducer to the enclosure via a screw threaded into the screw boss. At the meeting point with the interior surface, each of the plurality of molded ribs has a rib thickness measured perpendicular to the wall thickness, the rib thickness being less than 50 percent of the wall thickness.

The invention provides, in another aspect, a loudspeaker assembly including an enclosure having an open front side and a wall having an interior surface and an exterior surface with a wall thickness defined therebetween. The loudspeaker assembly also includes a screw boss integrally molded with the wall and supported by a plurality of molded ribs that extend inwardly from the interior surface. The screw boss defines a longitudinal axis. The loudspeaker assembly includes an audio transducer positioned within the enclosure and having an output side facing the open front side of the enclosure to emit sound therefrom, and a mount for securing the transducer to the enclosure via a screw threaded into the screw boss. The plurality of molded ribs have respective first ends adjacent an open receiving end of the screw boss and second ends opposite the first ends. At the first ends, individual rib end walls are radiused to vary in accordance with an offset distance from the screw boss longitudinal axis as viewed perpendicular to the interior surface.

The invention provides, in yet another aspect, a loudspeaker assembly including an enclosure having an open front side and a wall having an interior surface and an exterior surface with a wall thickness defined therebetween and includes a screw boss integrally molded with the wall and supported by a plurality of molded ribs that extend inwardly from the interior surface. The screw boss defines a longitudinal axis. The loudspeaker assembly includes an audio transducer positioned within the enclosure and having an output side facing the open front side of the enclosure to emit sound therefrom and includes a mount for securing the transducer to the enclosure via a screw threaded into the screw boss. The plurality of molded ribs have respective first ends adjacent an open receiving end of the screw boss and second ends opposite the first ends. Each of the first ends defines a meeting point with the interior surface to define a longitudinal end point. The respective longitudinal end points vary in longitudinal position in accordance with an offset distance from the screw boss longitudinal axis as viewed perpendicular to the interior surface.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
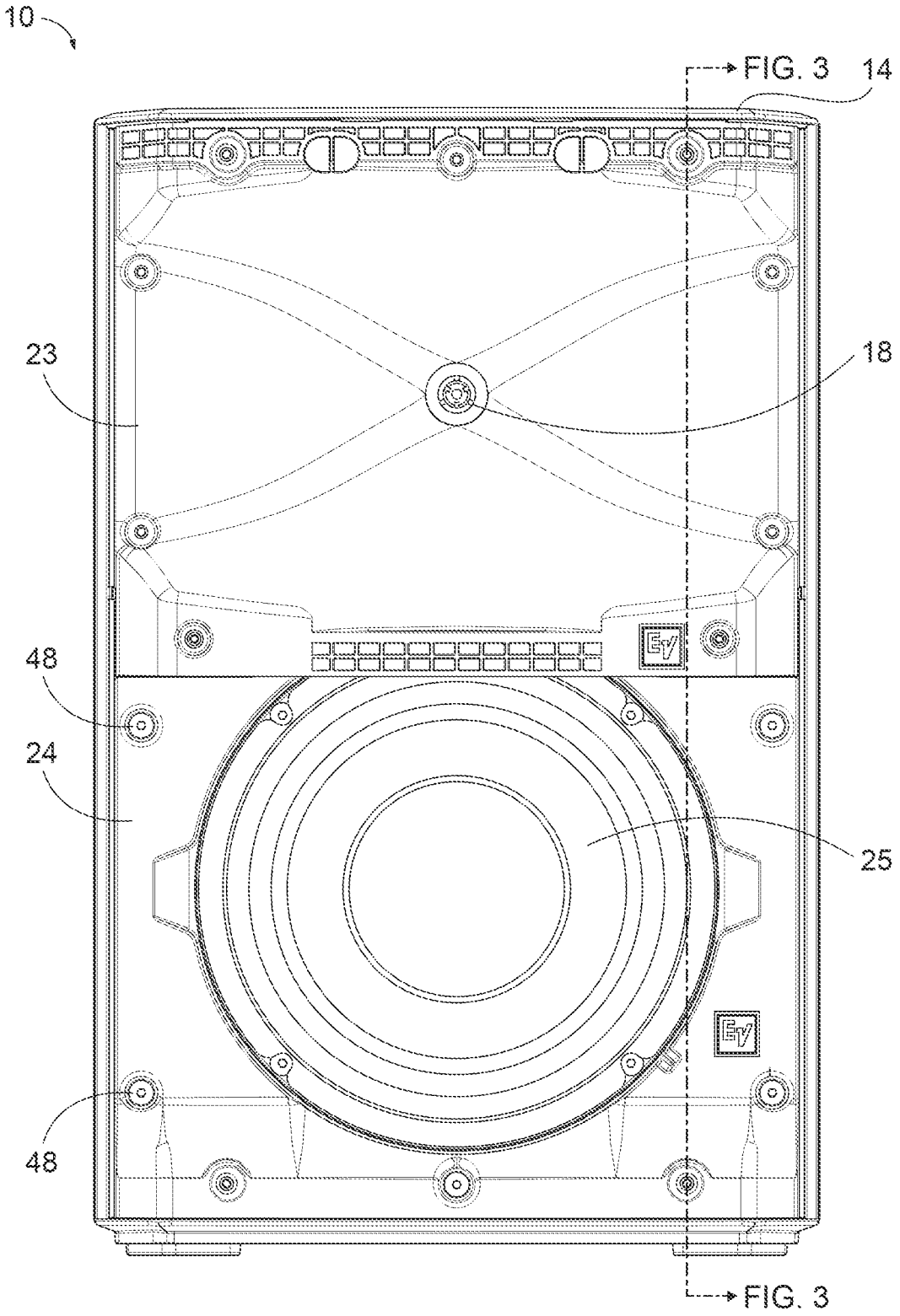
FIG. 1 is a front view of a loudspeaker assembly according to an embodiment of the invention.

A loudspeaker assembly 10, as shown in FIG. 1, includes an enclosure 14, a first transducer 18 and a second transducer 25 positioned within the enclosure 14. A first mount in the form of an acoustic horn 23 secures the first transducer 18 to the enclosure 14. A second mount in the form of a plate or a baffle 24 secures the second transducer 25 to the enclosure 14. In other embodiments, the acoustic horn 23 and the baffle 24 may be formed together as one mount. It is also noted that the loudspeaker assembly 10 may include a single mount for a single audio transducer, or more than two mounts for respective audio transducers (sometimes also referred to as "drivers"). The acoustic horn 23 is configured to provide precise directivity for the sound produced by the first transducer. The acoustic horn 23 is positioned directly adjacent the baffle 24.

In the illustrated embodiment, the first transducer 18 is a tweeter configured to output sound in a high-frequency register. The second transducer 25 is a woofer assembly configured to output sound in a lower frequency register than the first transducer 18. In other embodiments, the speaker assembly may include only one audio transducer, or more than two.

Figure 2:
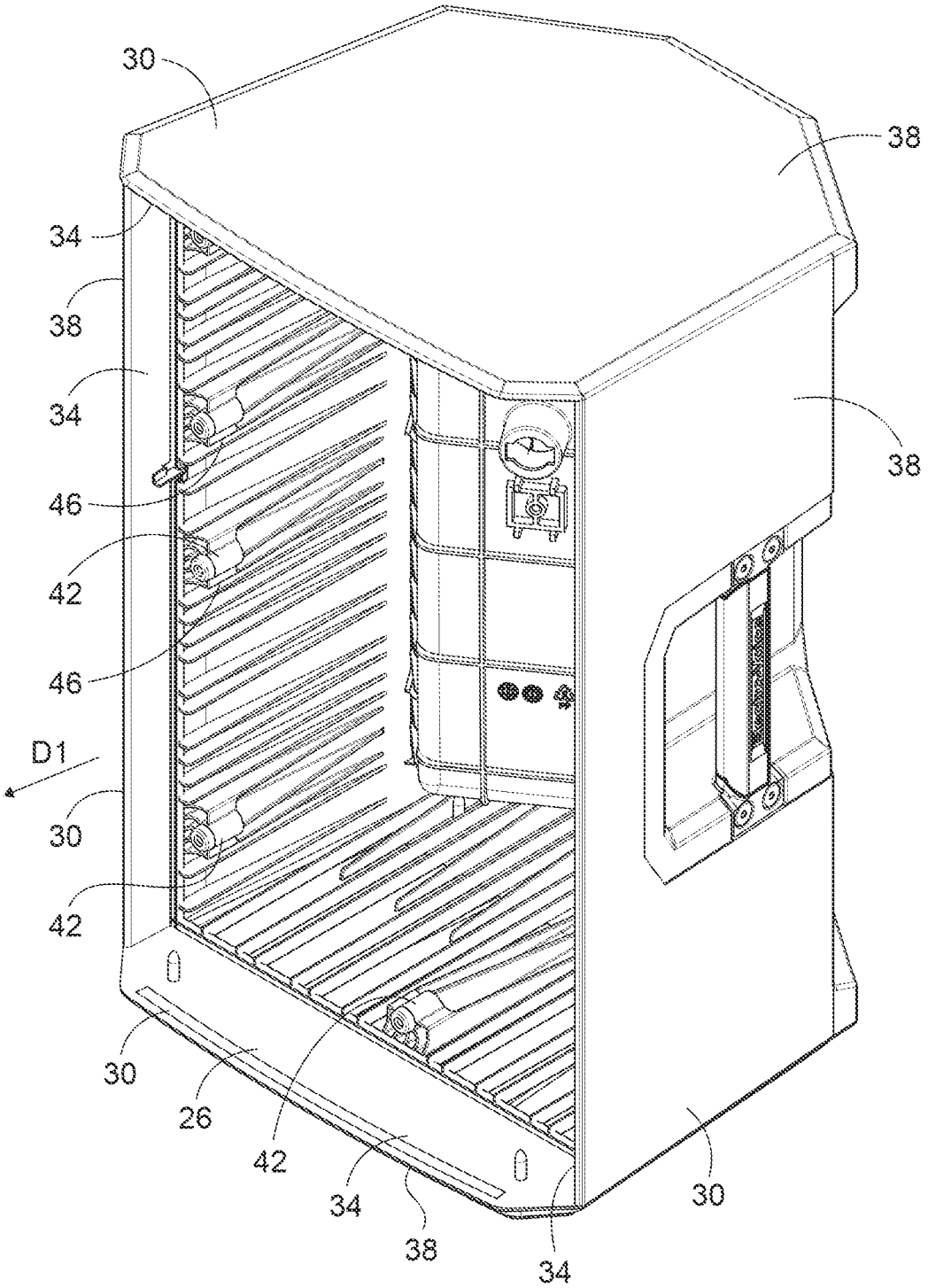
FIG. 2 is another perspective view of the loudspeaker assembly of FIG. 1 with a mount, a second transducer, and an acoustic horn removed.

With reference to FIG. 2, the enclosure 14 has an open front side 26 and a plurality of walls 30. As illustrated, the acoustic horn 23 and the baffle 24 are mounted to the interior of the enclosure 14 adjacent the open front side 26. The loudspeaker assembly 10 is configured to project or direct sound out of the enclosure 14 through the open front side 26. One or both of the transducers 18, 25 has an output side facing the open front side 26 of the enclosure 14 to emit the sound therefrom. In some scenarios, the loudspeaker assembly 10 can be arranged so that sound may be directed upwards toward a performer. The loudspeaker assembly 10 can alternately be arranged to project or direct sound to an audience. The loudspeaker assembly 10 may be mounted on a post or may be set on a flat surface such as a stage or a floor. The open front side 26 defines a forward direction D1 for projecting sound.

The plurality of walls 30 each have an interior surface 34 and an exterior surface 38 opposite the interior surface 34. The interior surfaces 34 face an interior of the enclosure 14 and the exterior surfaces 38 face an outside environment outside of the enclosure 14. A wall thickness t1 (see FIG. 4) is defined between the interior surface 34 and the exterior surface 38. Some or all of the interior surfaces 34 are planar in some constructions. A top one and a bottom one of the interior surfaces 34 are substantially parallel with each other and with the forward direction D1. A side one of the interior surfaces 34 and an opposite side one of the interior surfaces 34 are substantially parallel with each other and with the forward direction D1. Substantially parallel, as used herein, will be understood to refer to the absence of an angular offset or minimal angular offset, e.g., less than 10 degrees or less than 5 degrees.

The enclosure 14 is integrally molded with a plurality of screw bosses 42. The acoustic horn 23 and the baffle 24 secure the transducers 18, 25 to the enclosure 14 via screws 48 threaded into respective screw bosses 42. One or more of the walls 30, up to all of the walls 30, is integrally molded with at least one of the plurality of screw bosses 42. One or more of the walls 30, up to all of the walls 30, is integrally molded with at least two of the plurality of screw bosses 42. The screw bosses 42 are disposed adjacent the open front side 26. The screw bosses 42 are disposed so that the acoustic horn 23 and the baffle 24 engage the screw bosses 42. Each of the screw bosses 42 is supported by a rib structure 46 that extends inwardly from the interior surface 34 of one of the walls 30. The screw bosses 42 on each wall 30 are spaced from the interior surface 34 towards the interior of the enclosure 14 by the rib structure 46. Thus, the screw bosses 42 do not lie on or against the interior surface 34 of the wall 30.

The rib structures 46 are integrally molded with the plurality of screw bosses 42 and the wall 30 to which they are appended. In the illustrated embodiment, the rib structures 46 are identical to each other. Each of the screw bosses 42 includes a bore 44 configured to receive the screw 48 from the front side, e.g., in a direction opposite the forward direction D1. The acoustic horn 23 and the baffle 24 are each coupled to the enclosure 14 via a plurality of screws 48 threaded into a number of the plurality of screw bosses 42. The bores 44 of the screw bosses 42 can include internal threads configured to engage external threads of the screws 48. Alternately, the bores 44 are configured to plastically deform upon insertion of the screws 48. Thus, there are multiple ways to form a threaded joint at each screw boss 42. In some constructions, the screw bosses 42 may accommodate securement of the mounts with fasteners other than screws.

Figure 3:
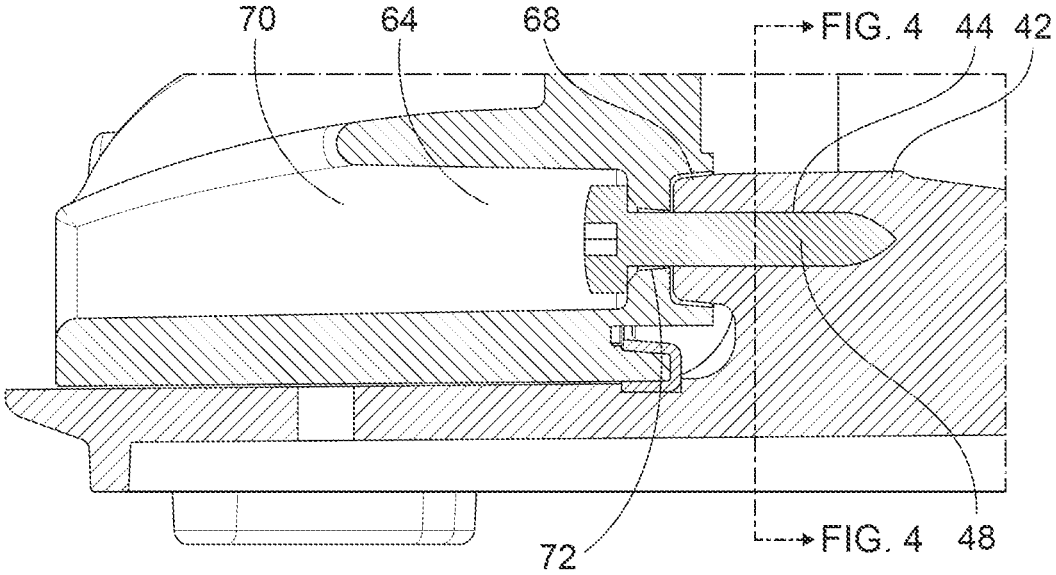
FIG. 3 is a cross-section view of a screw boss portion of the loudspeaker assembly, taken along line 3-3 of FIG. 1.
Figure 4:
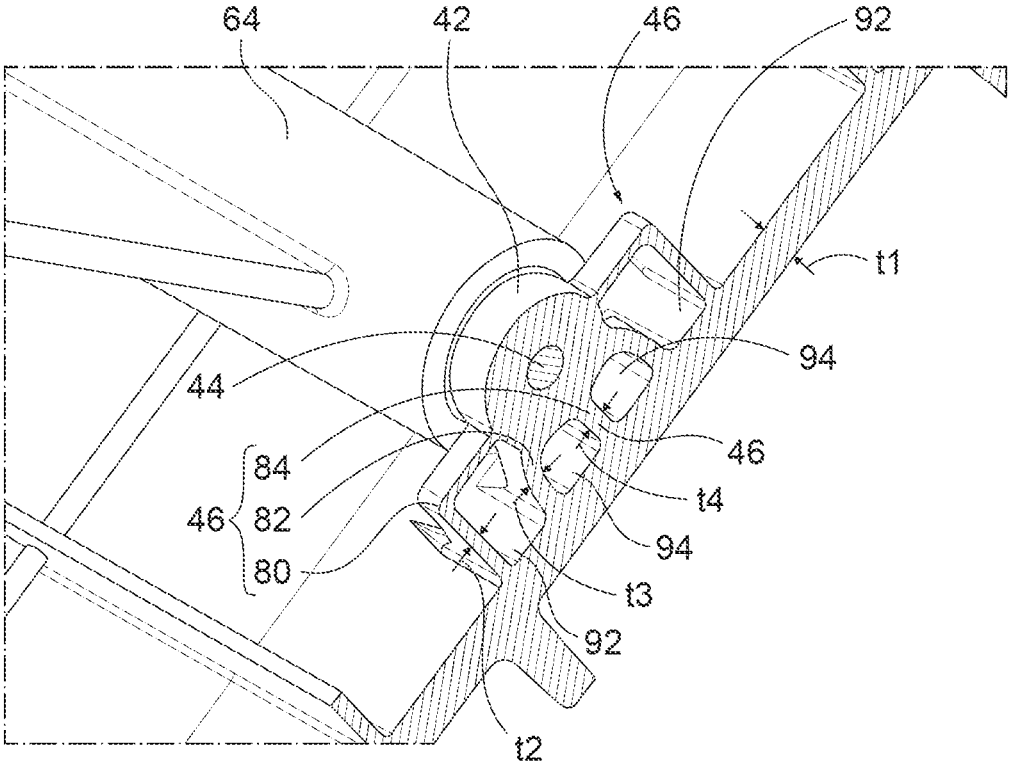
FIG. 4 is a cross-section view of a screw boss portion of the loudspeaker assembly, taken along line 4-4 of FIG. 3.

With reference to FIGS. 3 and 4, each of the acoustic horn 23 and the baffle 24 includes at least one retainer 64. A total number of the retainers 64 is equal to a number of the screw bosses 42 so that each retainer 64 corresponds to a respective one of the screw bosses 42. As illustrated, the retainer 64, which may be representative of some or all of the retainers 64, has a circular cross-section. The retainer 64 includes a first recess 68 configured to receive a portion of the screw boss 42. The retainer 64 also includes a second recess 70 configured to receive the screw 48. A through hole 72 extends through the retainer 64 as shown in FIG. 3. The through hole 72 opens into the first recess 68 and the second recess 70. The through hole 72 is configured to receive the screw 48. In order to mount the mount to the enclosure 14, the portion of screw boss 42 is inserted in the retainer 64 and the screw 48 is inserted in the through hole 72 and the bore 44.

Figure 5:
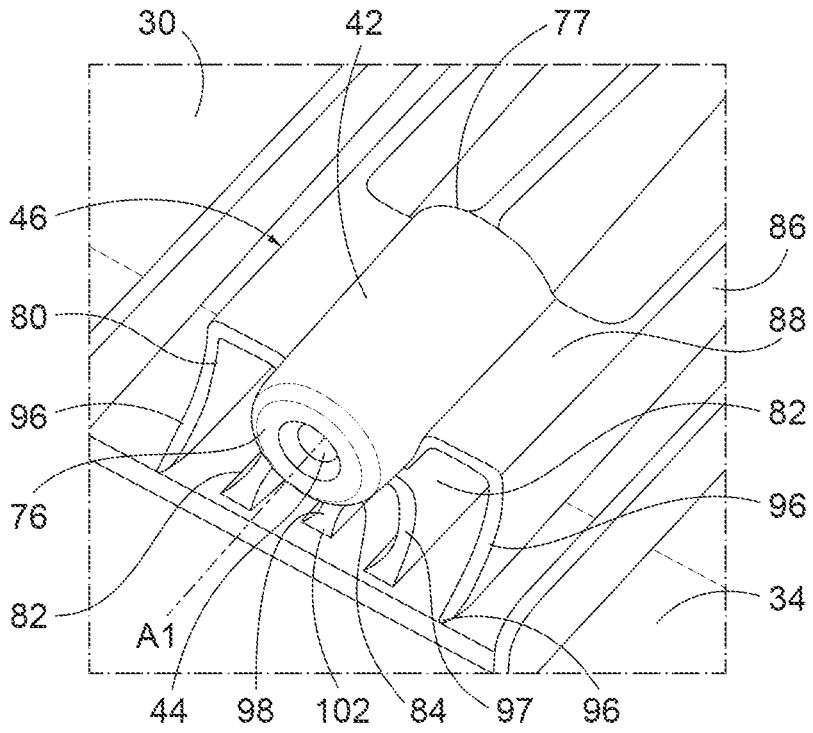
FIG. 5 is a perspective view of the screw boss portion of the loudspeaker assembly of FIG. 1.
Figure 6:
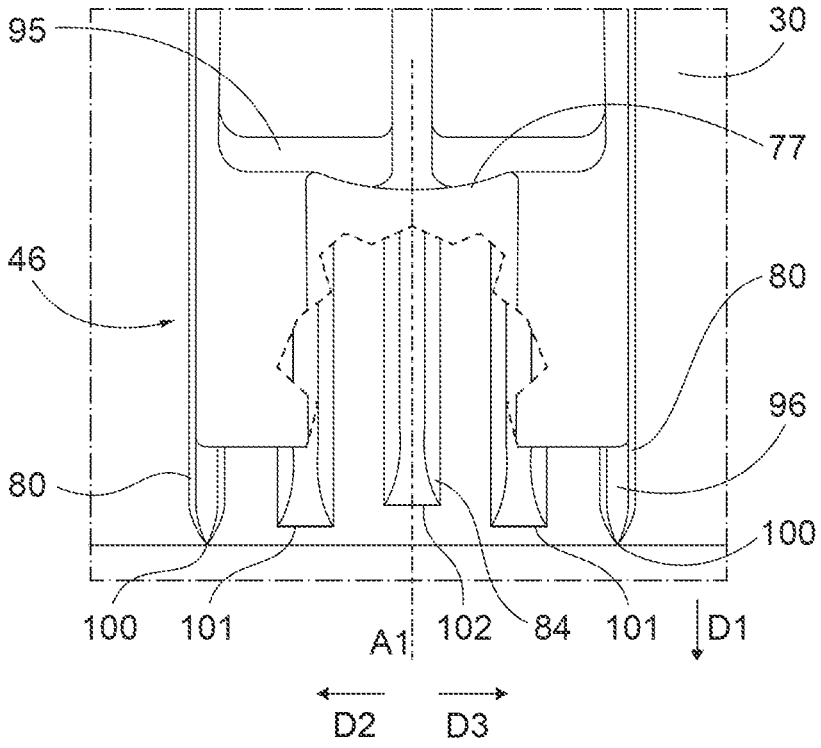
FIG. 6 is a top view of the screw boss portion of FIG. 5.

With reference to FIGS. 5 and 6, the screw boss 42 is substantially cylindrical, although it may have one or more tapers or chamfers and may be torpedo-shaped in some constructions. The screw boss 42 includes an open receiving end 76 and a rear end 77 opposite the open receiving end 76. The bore 44 of the screw boss 42 opens into the open receiving end 76. The screw boss 42 defines a screw boss longitudinal axis A1. The screw boss 42 has a circular cross-section perpendicular to the screw boss longitudinal axis A1. The bore 44 is defined along the longitudinal axis A1. The bore 44 of the screw boss 42 is centered on the screw boss longitudinal axis A1. The longitudinal screw boss axis Al is substantially parallel to the interior surface 34 and/or forward direction D1.

In the illustrated embodiment, the rib structure 46 includes outer ribs 80, inner ribs 82, and a central rib 84. The ribs 80, 82, 84 extend inwardly from the interior surface 34 of one of the walls 30. The rib structure 46 for each screw boss 42 includes two outer ribs 80, two inner ribs 82, and one central rib 84 for a total of five ribs. Each of the ribs 80, 82, 84 defines a longitudinal rib axis. The longitudinal rib axes are substantially parallel to each other. The longitudinal rib axes are substantially parallel to the screw boss longitudinal axis A1. The central rib 84 is positioned directly between the screw boss 42 and the wall 30. The central rib 84 is aligned with the screw boss longitudinal axis A1. By including the central rib 84 below the screw boss 42, the ribs 80, 82, 84 may have relatively small attachment points (e.g., less than half the nominal loudspeaker enclosure wall thickness t1) and therefore float the screw boss 42 off of the wall 30. As illustrated, the outer ribs 80 are symmetrical with each other across the screw boss longitudinal axis A1. The inner ribs 82 are symmetrical with each other across the screw boss longitudinal axis A1.

Each of the plurality of molded ribs 80, 82, 84 has a rib thickness t2, t3, t4. Each rib 80, 82, 84 may have a portion extending perpendicularly from the interior surface 34 of the wall 30, and in these portions, the respective rib thicknesses t2, t3, t4 are measured perpendicular to the wall thickness t1. The rib thicknesses t2, t3, t4 may be measured at a meeting point with the interior surface 34, disregarding fillet dimensioning. However, each of the ribs 80, 82, 84 may have a consistent thickness throughout. Each of the rib thicknesses t2, t3, t4 is less than the wall thickness t1. Specifically, each of the plurality of molded ribs 80, 82, 84 has a rib thickness t2, t3, t4 that is less than 50 percent of the wall thickness t1. The rib thickness t2, t3, t4 is selected to be thin enough to prevent the formation of sink marks on the exterior surface 38 of the wall 30 of the enclosure 14 during cooling of the molded material, while maintaining the mechanical strength of the ribs 80, 82, 84. In some embodiments, the rib thicknesses t2 of the outer ribs 80 may be thinner than the rib thicknesses t3 of the inner ribs 82 and the rib thickness t4 of the central rib 84. In other embodiments, the rib thicknesses t2 of the outer ribs 80 may be thicker than the rib thicknesses t3 of the inner ribs 82 and the rib thickness t4 of the central rib 84. In other embodiments, the rib thicknesses t2, t3, t4 of all of the ribs 80, 82, 84 are equal to each other. In some embodiments, the rib thickness of the inner ribs t3 may be equal to the rib thickness t4 of the central rib 84. In other embodiments, the rib thickness t4 of the central rib 84 may be thicker than the rib thicknesses t3 of the inner ribs 82.

The outer ribs 80 each include a main body 86 and a shoulder 88. The screw boss 42 is connected to the outer ribs 80 via shoulders 88 of the outer ribs 80. As illustrated, the shoulders 88 are normal to the circular cross-section of the screw boss 42. The shoulders 88 are substantially perpendicular to the main bodies 86 and are normal to an outer surface of the screw boss 42. The shoulders 88 are substantially parallel to the interior surface 34 of wall 30. The inner ribs 82 each include a curved profile extending from the screw boss 42 to the interior surface 34 of the wall 30. The central rib 84 extends from the screw boss 42 in a direction normal to the outer surface of the screw boss 42 to the interior surface 34 of the wall 30.

Each of the plurality of molded ribs 80, 82, 84 is spaced apart from the others to form spaces. The spaces have widths that are larger than the rib thicknesses t2, t3, t4 of the plurality of ribs 80, 82, 84. Outer spaces 92 (see FIG. 4) are each formed in between one of the outer ribs 80, one of the inner ribs 82, the wall 30 and the screw boss 42. Inner spaces 94 are each formed in between one of the inner ribs 82, the central rib 84, the wall 30, and the screw boss 42. Each of the spaces 92, 94 are delimited by a rear wall 95 extending from the rear end 76 of the screw boss 42 and towards the wall 30.

With reference to FIG. 5, the plurality of molded ribs 80, 82, 84 have respective first ends adjacent the open receiving end 76 of the screw boss 42 and respective second ends opposite the first ends. Each of the ribs 80, 82, 84 includes two opposing longitudinal surfaces extending between the first end and the second end along the longitudinal rib axis. Each of the plurality of ribs 80, 82, 84 additionally includes a fillet 91, 93, 95, respectively, at each intersection of the longitudinal surfaces and the wall 30.

As illustrated, at the first ends, individual rib end walls 96, 97, 98 are radiused to vary in accordance with an offset distance from the screw boss longitudinal axis A1 as viewed perpendicular to the interior surface 34. The respective rib end walls 96, 97, 98 are radiused with increasing radius measurements as the offset distance from the screw boss longitudinal axis Al increases, along a direction D2 (or opposite direction D3) perpendicular to the screw boss longitudinal axis A1. The directions D2, D3 are also substantially parallel to the interior surface 34. In other words, the respective rib end walls 96 of the outer ribs 80 have larger radius measurements than the respective rib end walls 97 of the inner ribs 82. The respective rib end walls 97 of the inner ribs 82 have larger radius measurements than the respective rib end wall 98 of the central rib 84. In other words, the rib end walls 96, 97, 98 get sequentially less flat and more curved closer to the axis A1. It is also noted that the rib end walls 96, 97, 98 get sequentially shorter closer to the axis A1 due to the shape and rib connection points of the screw boss 42.

As illustrated in FIG. 6, each of the first ends of the plurality of molded ribs 80, 82, 84 defines a meeting point with the interior surface 34 to define a longitudinal end point. The respective longitudinal end points vary in longitudinal position in accordance with the offset distance from the screw boss longitudinal axis A1, as viewed perpendicular to the interior surface 34. The variance in longitudinal positions of the ribs 80, 82, 84, causes an even distribution of stresses from the screw boss 42 on the wall 30. The respective longitudinal positions are increasingly forward in the forward direction D1 as the offset distance increases, either along the direction D2 or the opposite direction D3. In other words, the longitudinal end points 100 of the outer ribs 80 are more forward in the forward direction D1 than the longitudinal end points 101 of the of the inner ribs 82. The longitudinal end points 101 of the inner ribs 82 are more forward of the open receiving end 76 of the screw boss 42 than the longitudinal end point 102 of the central rib 84.

Figure 7:
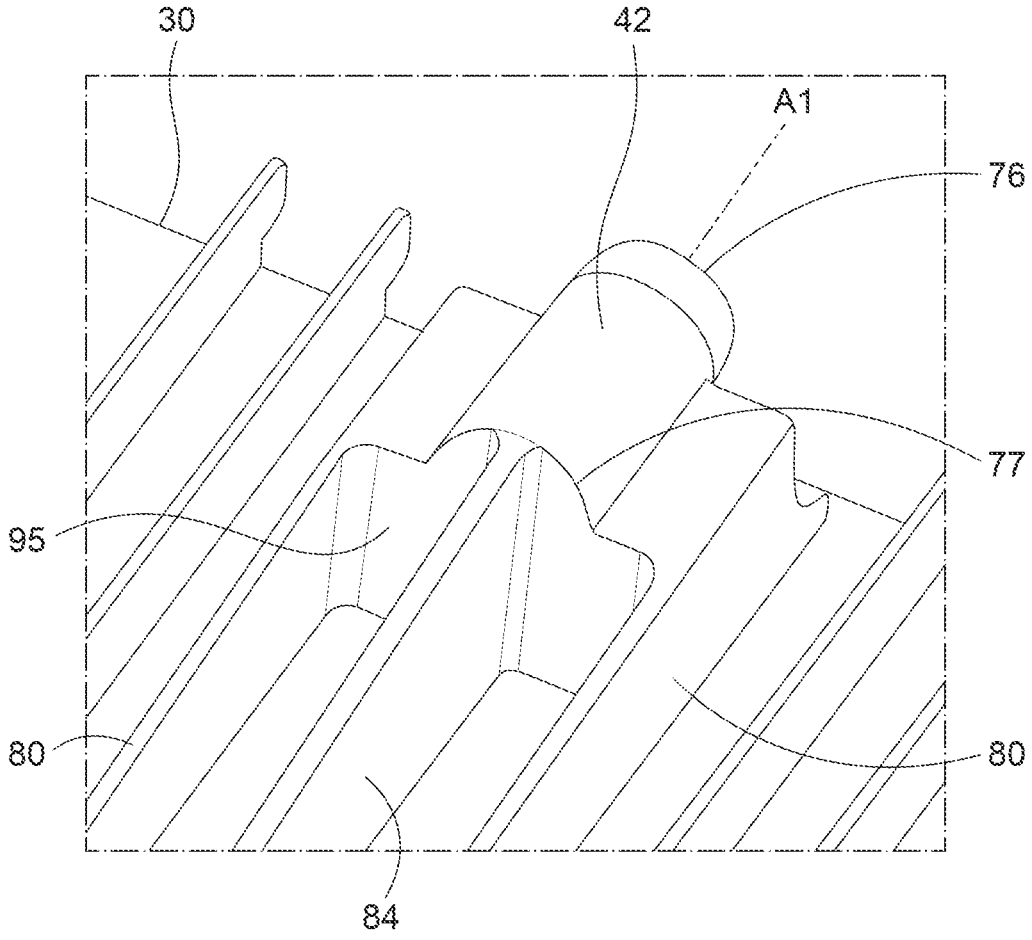
FIG. 7 is a rear perspective view of the screw boss portion of FIG. 5.

As illustrated in FIG. 7, the second ends of the outer ribs 80 extend past the rear end 77 of the screw boss 42 along the respective rib longitudinal axes. Along the respective rib longitudinal axes from the rear end 77 of the screw boss 42 to the second ends of the outer ribs 80, the heights of the outer ribs 80 taper towards the interior surface 34 of the wall 30. Rib height is measured perpendicular to the interior surface 34. The second end of the central rib 84 extends past the rear end 77 of the screw boss 42 along the central rib longitudinal axis. Along the central rib longitudinal axis from the rear end 77 of the screw boss 42 to the second end of the central rib 84, the height of the central rib 84 tapers towards the interior surface 34 of the wall 30. The inner ribs 82 are delimited by the rear wall 95 so that the inner ribs 82 do not extend past the rear end 77 of the screw boss 42.

Although the invention has been described in detail with reference to certain preferred embodiments, variations and modifications exist within the scope and spirit of one or more independent aspects of the invention as described.

What is claimed is:

1. A loudspeaker assembly comprising:

an enclosure having an open front side and a wall having an interior surface and an exterior surface with a wall thickness defined therebetween, wherein the wall is integrally molded with a screw boss supported by a plurality of molded ribs that extend inwardly from the interior surface;

an audio transducer positioned within the enclosure and having an output side facing the open front side of the enclosure to emit sound therefrom; and a mount for securing the transducer to the enclosure via a screw threaded into the screw boss;

wherein, at a meeting point with the interior surface, the plurality of molded ribs have respective rib thicknesses measured perpendicular to the wall thickness, the respective rib thicknesses being less than 50 percent of the wall thickness, and wherein the plurality of molded ribs are spread out wider than the screw boss and are spaced apart by a plurality of spaces having widths larger than the respective rib thicknesses.

2. The loudspeaker assembly of claim 1, wherein the screw boss defines a screw boss longitudinal axis along which a screw bore is defined, and wherein each of the plurality of molded ribs defines a longitudinal rib axis substantially parallel to the screw boss longitudinal axis.

3. The loudspeaker assembly of claim 2, wherein the screw boss longitudinal axis extends substantially parallel to the interior surface.

4. The loudspeaker assembly of claim 1, wherein the plurality of molded ribs includes five molded ribs.

5. The loudspeaker assembly of claim 1, further comprising a plurality of walls including the wall and a plurality of identical screw bosses including the screw boss, wherein each of the walls is integrally molded with at least one of the plurality of screw bosses.

6. The loudspeaker assembly of claim 1, wherein the plurality of molded ribs have respective first ends adjacent an open receiving end of the screw boss and second ends opposite the first ends, and wherein at the first ends, the rib end walls are radiused to vary in accordance with an offset distance from the screw boss longitudinal axis as viewed perpendicular to the interior surface.

7. The loudspeaker assembly of claim 6, wherein the respective rib end walls are radiused with increasing radius measurements as the offset distance increases.

8. The loudspeaker assembly of claim 1, wherein the plurality of molded ribs have respective first ends adjacent an open receiving end of the screw boss and second ends opposite the first ends, and wherein each of the first ends defines a meeting point with the interior surface to define a longitudinal end point, the respective longitudinal end points varying in longitudinal position in accordance with an offset distance from the screw boss longitudinal axis as viewed perpendicular to the interior surface.

9. The loudspeaker assembly of claim 8, wherein the respective longitudinal positions are increasingly forward in the forward direction as the offset distance increases.

10. A loudspeaker assembly comprising:

an enclosure having an open front side and a wall having an interior surface and an exterior surface with a wall thickness defined therebetween;

a screw boss integrally molded with the wall and supported by a plurality of molded ribs that extend inwardly from the interior surface, wherein the screw boss defines a longitudinal axis;

an audio transducer positioned within the enclosure and having an output side facing the open front side of the enclosure to emit sound therefrom; and a mount for securing the transducer to the enclosure via a screw threaded into the screw boss;

wherein the plurality of molded ribs have respective first ends adjacent an open receiving end of the screw boss and second ends opposite the first ends, and wherein at the first ends, individual rib end walls are radiused to vary in accordance with an offset distance from the screw boss longitudinal axis as viewed perpendicular to the interior surface.

11. The loudspeaker assembly of claim 10, wherein the respective rib end walls are radiused with increasing radius measurements as the offset distance increases.

12. The loudspeaker assembly of claim 10, wherein each of the first ends defines a meeting point with the interior surface to define a longitudinal end point, the respective longitudinal end points varying in longitudinal position in accordance with the offset distance.

13. The loudspeaker assembly of claim 11, wherein the open front side defines a forward direction for projecting sound, and wherein the respective longitudinal positions are increasingly forward in the forward direction as the offset distance increases.

14. The loudspeaker assembly of claim 10, wherein the screw boss includes a screw bore defined along the screw boss longitudinal axis, and wherein each of the plurality of molded ribs defines a longitudinal rib axis substantially parallel to the screw boss longitudinal axis.

15. The loudspeaker assembly of claim 13, wherein the screw boss longitudinal axis extends substantially parallel to the interior surface.

16. A loudspeaker assembly comprising:

an enclosure having an open front side and a wall having an interior surface and an exterior surface with a wall thickness defined therebetween;

a screw boss integrally molded with the wall and supported by a plurality of molded ribs that extend inwardly from the interior surface, wherein the screw boss defines a longitudinal axis;

an audio transducer positioned within the enclosure and having an output side facing the open front side of the enclosure to emit sound therefrom; and a mount for securing the transducer to the enclosure via a screw threaded into the screw boss;

wherein the plurality of molded ribs have respective first ends adjacent an open receiving end of the screw boss and second ends opposite the first ends, and wherein each of the first ends defines a meeting point with the interior surface to define a longitudinal end point, the respective longitudinal end points varying in longitudinal position in accordance with an offset distance from the screw boss longitudinal axis as viewed perpendicular to the interior surface.

17. The loudspeaker assembly of claim 16, wherein the open front side defines a forward direction for projecting sound, and wherein the respective longitudinal positions are increasingly forward in the forward direction as the offset distance increases.

18. The loudspeaker assembly of claim 16, wherein the screw boss includes a screw bore defined along the screw boss longitudinal axis, and wherein each of the plurality of molded ribs defines a longitudinal rib axis substantially parallel to the screw boss longitudinal axis.

19. The loudspeaker assembly of claim 18, wherein the screw boss longitudinal axis extends substantially parallel to the interior surface.

20. The loudspeaker assembly of claim 16, wherein the plurality of molded ribs includes five molded ribs, and wherein each of the plurality of molded ribs is spaced apart from each other.

* * * * *